US005360708A

United States Patent [19]

Takada et al.

[11] Patent Number: 5,360,708

[45] Date of Patent: Nov. 1, 1994

[54] SILVER HALIDE COLOR PHOTOGRAPHIC LIGHT-SENSITIVE MATERIAL

[75] Inventors: Masahito Takada; Eiichi Ueda; Hiromitsu Araki; Toru Kobayashi, all of Hino, Japan

[73] Assignee: Konica Corporation, Tokyo, Japan

[21] Appl. No.: 129,740

[22] Filed: Sep. 30, 1993

[30] Foreign Application Priority Data

Oct. 13, 1992 [JP] Japan ..... 4-300306

[51] Int. Cl.[5] ..... G03C 3/00

[52] U.S. Cl. ..... 430/496; 430/533; 430/501; 430/930; 430/523; 430/539

[58] Field of Search ..... 430/533, 501, 496, 930, 430/523, 539

[56] References Cited

U.S. PATENT DOCUMENTS

| | | | |
|---|---|---|---|
| 2,993,793 | 7/1961 | Beersmans et al. | 430/930 |
| 3,052,543 | 9/1962 | Bauer et al. | 430/535 |
| 4,011,358 | 3/1977 | Roelofs | 430/302 |
| 4,198,458 | 4/1980 | Mitsuishi et al. | 428/212 |
| 5,070,006 | 12/1991 | Krafft et al. | 430/523 |
| 5,138,024 | 8/1992 | Brozek et al. | 528/272 |
| 5,238,800 | 8/1993 | Hosoi et al. | 430/496 |

FOREIGN PATENT DOCUMENTS

| | | | |
|---|---|---|---|
| 275801 | 7/1988 | European Pat. Off. . | |
| 2120857 | 5/1990 | Japan | 430/930 |
| 116549 | 4/1992 | Japan . | |
| 4291340 | 10/1992 | Japan | 430/930 |

*Primary Examiner*—Thomas R. Neville
*Attorney, Agent, or Firm*—Jordan B. Bierman

[57] ABSTRACT

A silver halide photographic light-sensitive material comprises a polyester film support having curling in the lateral direction, a first side of the support being curled outwardly and a second side of the support being curled inwardly, a silver halide emulsion layer provided on the first side of the support, and a backing layer provided on the second side of the support, the ratio of the total gelatin content per unit area of the backing layer to that of the silver halide emulsion layer being within the range of from 0.05 to 0.7.

17 Claims, No Drawings

SILVER HALIDE COLOR PHOTOGRAPHIC LIGHT-SENSITIVE MATERIAL

FIELD OF THE INVENTION

The present invention relates to a silver halide photographic light-sensitive material, particularly to a silver halide photographic light-sensitive material in a roll form which is free from stains caused during the course of the developing process by means of a cine automatic processor, and is further free from scratches on the backing layer and free from deterioration of resolution caused in the print making operation.

BACKGROUND OF THE INVENTION

Compact cameras are widely used today. And, to make these compact cameras more handy to carry, much smaller ones are desired. In various attempts to realize the further miniaturization of these compact cameras, it is essential to reduce the space to house a photographic film.

When loaded in a compact camera, a photographic film is generally wound on a spool in roll. Therefore, to reduce the housing space for a photographic film without decreasing the number of exposures, the film itself must be made thinner. The thickness of a photographic support now in use is about 120 to 125 μm and considerably greater than that of a light-sensitive layer (20 to 30 μm) formed on the support. Accordingly, thinning a photographic support is the most effective means for reducing the thickness of a whole photographic film.

As photographic supports used now, triacetylcellulose (occasionally abbreviated as TAC) films are the most typical. However, TAC films are poor in mechanical strength by nature; therefore, when made much thinner, TAC films become apt to cause problems during conveyance or handling in a camera or in the developing process after photographing. Accordingly, it is not expedient to make the thickness of a TAC film support less than the thickness of a photographic support in use today.

On the other hand, polyethylene terephthalate films, which have so far been employed as films for X-ray photography or for photomechanical process in the photographic industry, are excellent in mechanical strength and, thereby, come to attract much attention as a photographic support which may enable the reduction of the thickness of a photographic film without lowering the mechanical strength.

Especially, the technique to provide a polyester resin with hydrophilicity disclosed in Japanese Pat. O.P.I. Pub. Nos. 120857/1990, 244446/1989, etc. has made possible to prevent polyester resin films from curl. Since then, active studies have been made with the aim of developing a thinner photographic film by use of a polyester resin support.

When such a polyester resin photographic support is used, a thinner photographic film can be certainly obtained; but, there arises a problem that the photographic film becomes apt to curl because of high expansion property, caused by moisture absorption an emulsion layer formed on one side of a support. To maintain a curling balance of a photographic film, there is a method of using gelatin in a backing layer formed on the side of the support opposite to the emulsion layer.

However, when gelatin was used in the backing layer and a cine automatic processor was used for processing, stain due to roll marks were generated on the backing layer, and it was found that serious problems due to excessive stain markedly deteriorated image quality of a print.

When the amount of gelatin used for the backing layer is reduced in order to solve this problem, the stain due to roll marks on the backing layer tend not to occur. In this method, however, curling balance of the film becomes insufficient, causing serious curling on the side of the emulsion layer. Due to this, scratches are easily made on the backing layer by a printer or the like. In addition, in printing, because curling has not been removed even after development. In addition, this curling causes a critical problem such as, out-of-focus or remarkable deterioration of image quality of prints are caused.

SUMMARY OF THE INVENTION

An object of the present invention is to solve the above-mentioned problem and to provide a silver halide photographic light-sensitive material wherein the occurrence of stain is prevented in the course of development by means of a cine automatic processor and the occurrence of scratches on the backing layer and the deterioration of resolution in printing can be prevented.

The above-mentioned object, has been attained by a silver halide photographic light-sensitive material comprising a polyester film support having curling in the lateral direction, a first side of the support being curled outwardly and a second side of the support being curled inwardly, a silver halide emulsion layer provided on the first side of the support, and a backing layer provided on the second side of the support, the ratio of the total gelatin content per unit area of the backing layer to that of the silver halide emulsion layer being within the range of from 0.05 to 0.7.

DETAILED DESCRIPTION OF THE INVENTION

The silver halide photographic light-sensitive material according to the invention (hereinafter occasionally referred to as the light-sensitive material) has on one side of photographic support (1) having a specific thickness at least one silver halide emulsion layer (2) and, on the other side of the support, a backing layer (3).

Polyester film Support (1)

The polyester film used in the present invention is not particularly limited as long as it exhibits an adequate strength when used in a photographic support. Examples thereof include a film of copolymer polyesters such as polyethylene terephthalate, polyethylene 2,6-dinaphthalate, polypropylene terephthalate and polybutyrene terephthalate obtained by condensation polymerization between an aromatic dicarboxylic acid, such as terephthalic acid, isophthalic acid, phthalic acid or naphthalene dicarboxylic acid, and a glycol, such as ethylene glycol, 1,3-propanediol or 1,4-butanediol.

In the embodiment of the invention, polyesters with high moisture content are preferred to prevent the curl. Of them, dicarboxylic acid having a metal sulfonate group as a copolymer component is preferred and polyethylene glycol is more preferred. Typical examples of such resins are polyester films having high moisture content ratio which can be seen, for example, in U.S. Pat. No. 3,052,543, Japanese Patent Publication Nos. 28336/1982, 33894/1984, Japanese Pat. O.P.I. Pub. Nos. 244446/1989 and U.S. Pat. No. 5,138,024.

When measured at 20° C. using a mixture solvent of phenol and 1,1,2,2-tetrachloroethane (60/40, by weight), the intrinsic viscosity of the polyester used in a photographic support according to the invention is preferably 0.4 to 1.0 and more preferably 0.5 to 0.8.

This photographic support may contain phosphoric acid, phosphorous acid and esters thereof as well as inorganic particles such as silica, kaloion, carcium carbonate, potassium phosphate and titanium dioxide, matting agents, antistatic agents, lubricants, surfactants, stabilizers, dispersants, plasticizers, UV absorbents, conductive materials, tackifiers, softening agents, fluidizing agents, thickeners and antioxidants.

Further, it is preferable for the polyester film support to contain dyes in order to prevent light piping caused by the incident light from the edge of a photographic support coated with photographic emulsion layers such as silver halide photographic light-sensitive layers. Types of such dyes are not particularly limited; but, preferred are anthraquinone dyes and the like which have a good heat resistance in the film forming process.

Further, it is preferable that the photographic support be tinted gray as is seen in general light-sensitive materials. As dyes for such tinting, there can be used, singly or in combination, the dyes on the market under the trade names of SUMIPLAST (Sumitomo Chemical Co.), DIARESIN (Mitsubishi Kasei Corp.), MACROLEX (Bayer AG), etc.

The photographic support of the invention can be manufactured by conventional methods such as solid phase polymerization of a polymer prepared by melt polymerization or solution polymerization.

The polyester film support of the invention can be manufactured, for example, by the steps of thoroughly drying the foregoing copolymer polyester, melt extruding it into a film shape through an extruder, a filter and a head each maintained within the range of 260° to 320° C., cooling the molten polymer to solid on a rotating cooling drum to obtain an unoriented film, and then heat setting the unoriented film under biaxial orientation.

The biaxial orientation is carried out by any of the following methods (A) to (C).

(A) A method of stretching an unoriented film in the longitudinal direction first and then stretching it in the lateral direction.

(B) A method of stretching an unoriented film in the lateral direction first and then stretching it in the longitudinal direction.

(C) A method of stretching an unoriented film in the longitudinal direction in a single step or multiple steps, stretching again in the longitudinal direction and then stretching it in the lateral direction.

In order to give an adequate mechanical strength and dimensional stability to the photographic support, the stretching is performed within the areal expansion rate of preferably 4 to 16 times.

The polyester film support of the invention may be a single layered film or sheet prepared in the foregoing manner, or may have composite structure comprising a film or sheet formed by the foregoing method and a film or sheet of another material bonded thereon by coextrusion or lamination. The resulting photographic support is especially suited for a photographic film used in the form of rolls.

There is no limitation of the thickness of a polyester film support. Any thickness can be selected depending upon a use. The preferable is not more than 125 μm. More preferable is 50 to 115 μm. Still more preferable is 75 to 100 μm. The thinner a support is, the more the effect of the invention is exhibited. However, if the support is too thin, mechanical strength thereof is lowered and it is impossible to be used as a photographic support.

Next, we will explain curling on a polyester film support of the present invention. "Curling of a support" is defined to be curling inherent in the support. The degree of curling can be measured according to the international standard ISO 4330. For example, a sample of support is cut by 35 mm in the lateral direction ×2–3 mm in the longitudinal direction. After the sample stands for 24 hours at 23° C. and 20 RH %, the degree of curling in the lateral direction is measured. It is represented by a 1/R indication (unit : 1/m) described in aforesaid international standard. "R" referred to herein is radius of curvature represented by meter. When a concave curling occurs on the emulsion side, curling is represented by "+". When concave curling occurs on the backing layer side, it is represented by "−".

In the present invention, concave curling preferably occurs on the backing layer side. It is more preferable to be in the range of −1 to −40 1/m in terms of 1/R indication.

As a method for providing inherent curling in the lateral direction to a polyester film support of the present invention of a mono layer film, a method disclosed in Japanese Patent Publication No. 70748/1989 wherein a polyester film is heated and is stretched in such a manner that the surface temperature of one side differs from the other side so that a gradation of temperature exists between the surfaces of one layer and the other. Another method to provide inherent curling is by coating on the film a subbing composition prepared by adding an organic solvent such as phenol or cresol which is a solvent or a swelling agent of the polyester film.

The support of the invention preferably comprises 2 or more polyester layers laminated. When 2 layers are laminated, 2 layers composing a film is preferable to be made of polyester layers for providing curling in the lateral direction of a polyester film. Their thicknesses may be the same or different each other. More preferably, the main component, the amount of the main component of the one layer of aforesaid lamination film or the kind the copolymer component or the amount of the copolymer component is different from the other. Though there is particularly no limitation thereto, they may be composed of a polyester layer and a copolymer polyester layer or a copolymer polyester layer and a copolymer polyester layer. A copolymer component is preferably includes an aromatic dicarbonxylic acid having a metal sulfonate group. Furthermore, it is preferable that they contain polyalkylene glycol and/or a saturated aliphatic dicarbonxylic acid. In this case, the copolymer component of the copolymerized polyester used is preferable to contain aromatic dicarbonxylic acid having a metal sulfonate group by 2 to 7 mol % to the total ester bond and it is especially preferable to contain polyalkylene glycol and/or a saturated aliphatic dicarbonate by 3 to 10% by weight to the total weight of aforesaid copolymer component. When a polyester film is composed of 2 layers, curling in the lateral direction can be provided to aforesaid film by adjusting the above-mentioned items suitably.

In the case of 3 layers structure, the outer 2 layers are preferable to be composed of polyester layers. However, there is no particular limitation to the center layer including a polyester layer or other substances such as polycarbonate, polyether, polyamide, polyimide, polyphthalamide and polyphthalimide. It is more preferable that all 3 layers are composed of polyester layers. As for layer constitution, it is preferable that the thickness of the outer layers are different from each other. When the thickness of each outer layer is defined to be $d_A$ and $d_B$ from thicker side, there is no especial limitation to the ratio of $d_A$ to $d_B$. However, it is allowed to be $1.1 < d_A/d_B < 5$ and preferable to be $1.3 < d_A/d_B < 3$. In addition, in the case of a 3-layer structure, the thickness of the outer layer may be the same or different. However, it is preferable that the main component, the amount of the main component of polyester or the specific viscosity of the upper layer and the lower layer which are the outer layers of aforesaid lamination film are different from each other. In this case, the copolymer component of the copolymerized polyester used is preferable to contain aromatic dicarbonate having a metal sulfonate group by 2 to 7 mol % to the total ester bond and it is especially preferable to contain polyalkylene glycol and/or a saturated aliphatic dicarbonate by 3 to 10% by weight to the total weight of aforesaid copolymer component. When a film is composed of 3 layers, curling in the lateral direction can be provided to aforesaid film can be provided. The difference of specific viscosity $\Delta IV$ is allowed to be 0.02 to 0.5, preferably 0.05 to 0.4 and particularly preferably 0.1 to 0.3.

When a film is composed of 2 layers, 3 layers or 4 or more layers, what is necessary for curling in the lateral direction to aforesaid film of the present invention is asymmetricity of the layer structure between the upper layers and the lower layers when the thickness of aforesaid film is halved.

"Asymmetricity" referred to here is not especially limited. However, it includes the differences in the order of the layer structures composed of polyester layers and other substances, difference in the thickness of polyester layers or other layers, difference in the amount of main component of polyester between the upper side and the lower side of the halved surface and the difference in the kind or the amount of copolymer component or specific viscosity.

A method to measure the above-mentioned asymmetricity of lamination film includes one using various analytic instruments. Though there is no limitation thereto, the section of layer structures can be pictured by the use of microscope observation and microscope photography. In addition, it is allowed that each layer is cut off while aforesaid film is subjected to microscope observation or it is cut off from the uppermost layer and the lowermost layer up to the surface separating them by halves so that they are subjected to hydrolysis for measurement using instrument such as liquid chromatography measurement or NMR. In addition, it is allowed to measure the specific viscosity using NMR or GPC (Gelpermission chromatography) of objective material after it is dissolved in a solvent. In addition, the objective material can be subjected to X-ray spectral instrument measurement or IR (infrared spectral instrument) measurement after mixing it with KBr. As a result, asynchronisity can be measured using specific amount of material, the difference in the position of peak or difference in strength of the measurement results corresponding to it.

When the film of the present invention is of a 2-layer lamination structure, in the case that they are composed of a polyester layer and a copolymer polyester layer, the copolymer polyester layer side ordinarily has concave curling in the lateral direction. In the case that both are composed of copolymer polyester layers, curling in the lateral direction can be provided by adjusting the thickness of layers and the amount of the components. When a film is composed of 3 layers, in the case that the outer layer is composed of a copolymer polyester layer, the above-mentioned $d_A$ side can ordinarily provide concave curling in the lateral direction. In the case that the inner layer is composed of a copolymer layer and the outer layer is composed of a polyester layer, $d_B$ side can ordinarily provide concave curling in the lateral direction. In addition, a film of the present invention is not given any particular limitation even when it is composed of 2, 3, 4 or more layers. By adjusting the above-mentioned factors such as the layer structure, layer thickness and the amount of copolymer component, curling in the lateral direction can be provided.

Silver Halide Emulsion Layer (2)

Silver halide emulsion layers can be formed by coating silver halide emulsions containing silver halides and other components, directly or indirectly on one side or both sides of a photographic support, using various coating methods.

Such silver halide emulsion layers may be formed on a polyester film support, directly, or via another layer such as a hydrophilic colloid layer containing no silver halide emulsion. Further, there may also be provided a hydrophilic colloid layer as protective layer on the silver halide emulsion layers. These silver halide emulsion layers may be formed in different sensitivities; for example, these may be divided into a high speed emulsion layer and a low-speed emulsion layer. In this case, an intermediate layer may be provided between these emulsion layers; that is, an intermediate layer comprising hydrophilic colloid may be provided when necessary. In addition, there may also be provided, between a silver halide emulsion layer and a protective layer, a nonlight-sensitive hydrophilic colloid layer such as an intermediate layer, a protective layer, an antihalation layer or a backing layer.

Silver halides used in these silver halide emulsions may have any composition. Examples of usable silver halides include silver chloride, silver chlorobromide, silver chloroiodobromide, pure silver bromide and silver iodobromide.

Further, these silver halide emulsions may contain other components such as binders, sensitizing dyes, plasticizers, antistatic agents, surfactants and hardeners.

As a method for coating the above-mentioned silver halide emulsion layers, various methods including a dip coating method, an air knife coating method, a curtain coating method and an extrusion coat method can be used. By the use of these, coating can be conducted one layer at a time, or multi layers can be coated simultaneously.

The added amount of hydrophilic colloid in emulsion layers is 0.5 to 30 $g/m^2$.

Backing Layer (3)

The backing layer can be obtained by coating one or plural layers comprising a gelatin-containing backing layer composition on a photographic support opposite to the silver halide emulsion layers.

In the present invention, fluorine type anion surfactants and fluorine-containing cation surfactants can be added to the outermost layer of the above-mentioned backing layer.

Suitable gelatins are coal-processed gelatins, acid-processed gelatins and alkali-processed gelatins. Gelatin derivatives prepared by hydrolysis or enzyme-decomposition of gelatin can also be used.

The backing layer in the invention may further contain other conventional compounds, such as hydrophilic colloid, matting agents, lubricants, surfactants, hardeners, dyes, thickeners and polymer lattices.

As the above-mentioned hydrophilic colloid, compounds having similar characteristics as gelatin such as natural or synthetic hydrophilic polymers can be cited. There is no limitation to the added amount of hydrophilic colloid in the backing layer as far as it is included within the ratio range of the present invention. The preferable content is 0.1 to 15 g/m$^2$.

It is more preferable when the ratio X of the total amount of gelatin per unit area on the side having the backing layer to that on the side having emulsion layers satisfies the following inequality:

$$\text{Inequality } \frac{K+15}{50} \leqq X \leqq \frac{K+55}{50}$$

wherein K represents the 1/R value (unit : 1/m) according to the ISO 4330 at 23° C. and 20% RH and X represents the ratio of the total gelatin content per unit area on the side having the backing layer to that on the side having the silver halide emulsion layer.

Suitable examples of these matting agent, lubricant, surfactant and hardener can be seen, for example, in sections XVI, XII, XI and X of Research Disclosure No. 17643 (1978).

The thickness of the backing layer in the present invention is ordinarily 0.5 to 15 μm and preferably 2–10 μm taking into consideration the thickness of the total film, prevention of reverse curling and curl balance. The backing layer may be composed of 2 or more different layers. Development of Silver Halide Photographic Light-Sensitive Materials.

The silver halide photographic light-sensitive material of the invention can be developed by use of conventional developers described, for example, in T. H. James, The Theory of the Photographic Process, Forth Edition, pp. 291–334 and Journal of the American Chemical Society, vol. 73, p. 3,100 (1951).

EXAMPLES

Hereunder, we will explain examples of the present invention.

A. Manufacturing polyester film support (Preparation of support 1)

Polyethylene terephthalate (the specific viscosity is 0.65) melt-extruded in a film form from a T-die at 280° C. was quenched on a cooling drum, so that an unoriented film was obtained. This unoriented film was stretched 3 times in the longitudinal direction and further stretched 3 times in the lateral direction at 75° C., followed by heat setting at 220° C. Thus, a polyester film support 1 having thickness of 80 μm was prepared.

(Preparation of Support 2)

Support 2 was prepared in the same manner as Support 1 except that an unoriented film was stretched 3 times in the longitudinal direction in the manner that the surface temperature on the emulsion side of the support is 85° C. and that on the backing layer side of the support is 75 ° C.

(Preparation of Supports 3–6)

A mixture of 100 parts by weight of dimethyl terephthalate, 64 parts by weight of ethylene glycol and 0.1 part by weight of hydrated calcium acetate as a transesterification catalyst was transesterified in the usual manner.

To the product were added 28 parts by weight of 35 wt % ethylene glycol solution of 5-sodiumsulfo-di(β-hydroxyethyl)isophthalic acid (SIP), 8.1 parts by weight of polyethylene glycol (PEG) (number average molecular weight: 3000). Then, 0.05 part by weight of antimony trioxide and 0.13 part by weight of trimethyl phosphate were added thereto. After gradually raising the temperature to 280° C. and reducing the pressure to 0.5 mmHg, the mixture was polymerized under these conditions to obtain a copolymerized polyester with the specific viscosity of 0.55.

Using the above-mentioned copolymer polyester and polyethylene terephthalate for photographic use used for a polyester layer (the specific viscosity is 0.65), a support for photographic use was prepared in the following manner:

After the above-mentioned copolymer polyester and polyethylene terephthalate were respectively subjected to vacuum drying at 150° C., they were melt-extruded at 285° C. using 3 units of extruders and they are jointed in layer form inside a T dise so that copolymer polyester, polyethylene terephthalate and copolymer ester are coated in this order from the emulsion side on the support with the thickness ratio as shown in Table 1. Then, by quenching it on a cooling drum, so that a polyester-laminated unoriented film was obtained. This unoriented laminated film was stretched 3.5 times in the longitudinal direction at 85° C. and further stretched 3.5 times in the lateral direction at 95° C., followed by heat setting at 210° C. Thus, polyester film support 3–6 having a thickness of 80 μm were prepared.

B. Preparation of Light-sensitive Material

The above photographic support was subjected to corona discharge treatment on both sides at 8 W/m$^2$.min. Then, subbing layer B-3 was formed on one side of the support by coating the following subbing solution B-3 to a dry coating thickness of 0.8 μm, and subbing layer B-4 was formed on the other side of the support by coating the following subbing solution B-4 to a dry coating thickness of 0.8 μm.

| | |
|---|---|
| <Subbing Solution B-3> | |
| Latex comprising a copolymer of 30 wt % butyl acrylate, 20 wt % t-butyl acrylate, 25 wt % styrene, and 25 wt % 2-hydroxyethyl acrylate (30 wt % solid content) | 270 g |
| Compound UL-1 | 0.6 g |
| Hexamethylene-1,6-bis(ethylene urea) | 0.8 g |
| Water was added to | 1,000 ml |
| <Subbing Solution B-4> | |
| Latex comprising a copolymer of 40 wt % butyl acrylate, 20 wt % styrene, and 40 wt % glycidyl acrylate (30 wt % solid content) | 270 g |
| Compound UL-1 | 0.6 g |
| Hexamethylene-1,6-bis(ethylene urea) | 0.8 g |
| Water was added to | 1,000 ml |

After subjecting subbing layers B-3 and B-4 to corona discharge treatment at 8 W/m$^2$.min, subbing layer B-5 was formed on subbing layer B-3 by coating the following subbing solution B-5 to a dry coating thickness of 0.1 μm, and subbing layer B-6 having an antistatic property was formed on subbing layer B-4 by coating the following subbing solution B-6 to a dry coating thickness of 0.8 μm.

| <Subbing Solution B-5> | |
|---|---|
| Gelatin | 10 g |
| Compound UL-1 | 0.2 g |
| Compound UL-2 | 0.2 g |
| Compound UL-3 | 0.1 g |
| Silica particles (average particle size: 3 μm) | 0.1 g |
| Water was added to | 1,000 ml |
| <Subbing Solution B-6> | |
| Water-soluble conductive polymer UL-4 | 60 g |
| Latex comprising compound UL-5 (20% solid content) | 80 g |
| Ammonium sulfate | 0.5 g |
| Hardener UL-6 | 12 g |
| Polyethylene glycol (weight average molecular weight: 600) | 6 g |
| Water was added to | 1,000 ml |

The chemical structures of compounds UL-1 to 6 are shown later collectively.

A 25-W/m$^2$.min corona discharge was given to subbing layer B-5, and a 8-W/m$^2$.min corona discharge to subbing layer B-6. A silver halide photographic materials 1 to 5 were prepared by forming the following emulsion layer in sequence on subbing layer B-5, and the following backing layer on subbing layer B-6.

Then, silver halide photographic light-sensitive material samples 001 to 022 were prepared by changing the total added amount of gelatin as shown in Table 1 while the ratio of gelatin amount between each backing layer was kept the same.

Hereunder, we will show the formulas of <Backing layers> and <Emulsion layers> when the added amount of gelatin is 6 g/m$^2$.

The amounts of components in the following backing layers, emulsion layers, etc. are per square meter.

| <Backing Layers> | |
|---|---|
| 1st layer: | |
| Gelatin | 4.5 g |
| Sodium-di-(2-ethylhexyl)-sulfosuccinate | 1.0 g |
| Sodium tripolyphosphate | 76 mg |
| Citric acid | 16 mg |
| Carboxyalkyldextran sulfate | 49 mg |
| Vinyl sulfone type hardener | 23 mg |
| 2nd layer (The outermost layer): | |
| Gelatin | 1.5 g |
| Polymer beads (average particle size: 3 μm, polymethyl methacrylate) | 24 mg |
| Sodium-d-(2-ethylhexyl)-sulfosuccinate | 15 mg |
| Carboxyalkyldextran sulfate | 12 mg |
| Vinyl sulfon type hardener | 30 mg |
| Mixture between a fluorine type anion surfactant (Compound FA-1) and a fluorine cation surfactant (Compound FK-1) (Mole ratio is 1:1) | 20 mg |
| Compound (Compound A) | 250 mg |
| <Emulsion Layers> | |
| 1st layer: antihalation layer HC | |
| Black colloidal silver | 0.15 g |
| UV absorbent UV-1 | 0.20 g |
| Compound CC-1 | 0.02 g |
| High boiling solvent Oil-1 | 0.20 g |
| High boiling solvent Oil-2 | 0.20 g |
| Gelatin | 1.6 g |
| 2nd layer: intermediate layer IL-1 | 1.3 g |
| Gelatin | |
| 3rd layer: low-speed red-sensitive emulsion layer R-L | |
| Silver iodobromide emulsion (average grain size: 0.3 μm, average iodide content: 2.0 mol %) | 0.4 g |

-continued

| | |
|---|---|
| Silver iodobromide emulsion (average grain size: 0.4 μm, average iodide content: 8.0 mol %) | 0.3 g |
| Sensitizing dye S-1 | $3.2 \times 10^{-4}$ (mol/mol of silver) |
| Sensitizing dye S-2 | $3.2 \times 10^{-4}$ (mol/mol of silver) |
| Sensitizing dye S-3 | $0.2 \times 10^{-4}$ (mol/mol of silver) |
| Cyan coupler C-1 | 0.50 g |
| Cyan coupler C-2 | 0.13 g |
| Colored cyan coupler CC-1 | 0.07 g |
| DIR compound D-1 | 0.006 g |
| DIR compound D-2 | 0.01 g |
| High boiling solvent Oil-1 | 0.55 g |
| Gelatin | 1.0 g |
| 4th layer: high-speed red-sensitive emulsion layer RH | |
| Silver iodobromide emulsion (average grain size: 0.7 μm, average iodide content: 7.5 mol %) | 0.9 g |
| Sensitizing dye S-1 | $1.7 \times 10^{-4}$ (mol/mol of silver) |
| Sensitizing dye S-2 | $1.6 \times 10^{-4}$ (mol/mol of silver) |
| Sensitizing dye S-3 | $0.1 \times 10^{-4}$ (mol/mol of silver) |
| Cyan coupler C-2 | 0.23 g |
| Colored cyan coupler CC-1 | 0.03 g |
| DIR compound D-2 | 0.02 g |
| High boiling solvent Oil-1 | 0.25 g |
| Gelatin | 1.0 g |
| 5th layer: intermediate layer IL-2 | 0.8 g |
| Gelatin | |
| 6th layer: low-speed green-sensitive emulsion layer GL | |
| Silver iodobromide emulsion (average grain size: 0.4 μm, average iodide content: 8.0 mol %) | 0.6 g |
| Silver iodobromide emulsion (average grain size: 0.3 μm, average iodide content: 2.0 mol %) | 0.2 g |
| Sensitizing dye S-4 | $6.7 \times 10^{-4}$ (mol/mol of silver) |
| Sensitizing dye S-5 | $0.8 \times 10^{-4}$ (mol/mol of silver) |
| Magenta coupler M-1 | 0.17 g |
| Magenta coupler M-2 | 0.43 g |
| Colored magenta coupler CM-1 | 0.10 g |
| DIR compound D-3 | 0.02 g |
| High boiling solvent Oil-2 | 0.7 g |
| Gelatin | 1.0 g |
| 7th layer: high-speed green-sensitive layer GH | |
| Silver iodobromide emulsion (average grain size: 0.7 μm, average iodide content: 7.5 mol %) | 0.9 g |
| Sensitizing dye S-6 | $1.1 \times 10^{-4}$ (mol/mol of silver) |
| Sensitizing dye S-7 | $2.0 \times 10^{-4}$ (mol/mol of silver) |
| Sensitizing dye S-8 | $0.3 \times 10^{-4}$ (mol/mol of silver) |
| Magenta coupler M-1 | 0.30 g |
| Magenta coupler M-2 | 0.13 g |
| Colored magenta coupler CM-1 | 0.04 g |
| DIR compound D-3 | 0.004 g |
| High boiling solvent Oil-2 | 0.35 g |
| Gelatin | 1.0 g |
| 8th layer: yellow filter layer YC | |
| Yellow colloidal silver | 0.1 g |
| Additive HS-1 | 0.07 g |
| Additive HS-2 | 0.07 g |
| Additive SC-1 | 0.12 g |
| High boiling solvent Oil-2 | 0.15 |
| Gelatin | 1.0 g |
| 9th layer: low-speed blue-sensitive emulsion layer BL | |
| Silver iodobromide emulsion (average grain size: 0.3 μm, average iodide content: 2.0 mol %) | 0.25 g |

-continued

| | |
|---|---|
| Silver iodobromide emulsion (average grain size: 0.4 μm, average iodide content: 8.0 mol %) | 0.25 g |
| Sensitizing dye S-9 | $5.8 \times 10^{-4}$ (mol/mol of silver) |
| Yellow coupler Y-1 | 0.6 g |
| Yellow coupler Y-2 | 0.32 g |
| DIR compound D-1 | 0.003 g |
| DIR compound D-2 | 0.006 g |
| High boiling solvent Oil-2 | 0.18 g |
| Gelatin | 1.3 g |
| 10th layer: high-speed blue-sensitive emulsion layer BH | |
| Silver iodobromide emulsion (average grain size: 0.8 μm, average iodide content: 8.5 mol %) | 0.5 g |
| Sensitizing dye S-10 | $3 \times 10^{-4}$ (mol/mol of silver) |
| Sensitizing dye S-11 | $1.2 \times 10^{-4}$ (mol/mol of silver) |
| Yellow coupler Y-1 | 0.18 g |
| Yellow coupler Y-2 | 0.10 g |
| High boiling solvent Oil-2 | 0.05 g |
| Gelatin | 2.0 g |
| 11th layer: 1st protective layer PRO-1 | |
| Silver iodide (average grain size: 0.08 μm) | 0.3 g |
| UV absorbent UV-1 | 0.07 g |
| UV absorbent UV-2 | 0.10 g |
| Additive HS-1 | 0.2 g |
| Additive HS-2 | 0.1 g |
| High boiling solvent Oil-1 | 0.07 g |
| High boiling solvent Oil-3 | 0.07 g |
| Gelatin | 0.8 g |
| 12th layer: 2nd protective layer PRO-2 | |
| Compound A | 0.04 g |
| Compound B | 0.004 g |
| Polymethyl methacrylate (average particle size: 3 μm) | 0.02 g |
| Methyl methacrylate:ethyl methacrylate:methacrylic acid 3:3:4 (weight ratio) copolymer (average particle size: 3 μm) | 0.13 g |
| Gelatin | 0.7 g |

Preparation of Silver Iodobromide Emulsion

The silver iodobromide emulsion used in the 10th layer was prepared by the following method.

Silver iodobromide grains having an average grain size of 0.33 μm (a silver iodide content of 2 mol %) were prepared by the double-jet method, using monodispersed silver iodobromide grains as seed grains.

While stirring the following solution G-1 under conditions of 70° C., pAg 7.8 and pH 7.0, 0.34 mol of the seed emulsion was added thereto.

(Formation of Inner High Iodide Content Phase-Core Phase)

Then, the following solutions H-1 and S-1 were added, while keeping the flow ratio at 1:1, in 86 minutes at an accelerated flow rate (the final flow rate was 3.6 times the initial flow rate).

(Formation of Outer Low Iodide Content Phase-Shell Phase)

Subsequently, the following solutions H-2 and S-2 were added at a flow ratio of 1:1 in 65 minutes, under conditions of pAg 10.1 and pH 6.0, while accelerating the flow rate so as to make the final flow rate 5.2 times the initial flow rate.

During grain formation, the pAg and pH were controlled with an aqueous solution of potassium bromide and an aqueous solution of 56% acetic acid. The resulting silver halide grains were desalted according to the usual flocculation method and redispersed with the addition of gelatin to give an emulsion, which was then adjusted to pH 5.8 and pAg 8.06 at 40° C.

The emulsion thus obtained was a monodispersed emulsion comprising octahedral silver iodobromide grains having an average grain size of 0.80 μm, a grain size distribution extent of 12.4% and a silver iodide content of 8.5 mol %.

| | |
|---|---|
| Solution G-1 | |
| Ossein gelatin | 100.0 g |
| 10 wt % methanol solution of the following compound-I | 25.0 ml |
| 28% aqueous ammonia | 440.0 ml |
| 56% aqueous acetic acid solution | 660.0 ml |
| Water was added to | 5,000.0 ml |
| Solution H-1 | |
| Ossein gelatin | 82.4 g |
| Potassium bromide | 151.6 g |
| Potassium iodide | 90.6 g |
| Water was added to | 1,030.5 ml |
| Solution S-1 | |
| Silver nitrate | 309.2 g |
| 28% Aqueous ammonia | equivalent |
| Water was added to | 1,030.5 ml |
| Solution H-2 | |
| Ossein gelatin | 302.1 g |
| Potassium bromide | 770.0 g |
| Potassium iodide | 33.2 g |
| Water was added to | 3,776.8 ml |
| Solution S-2 | |
| Silver nitrate | 1,133.0 g |
| 28% Aqueous ammonia | equivalent |
| Water was added to | 3,776.8 ml |

*Compound-I: sodium polypropyleneoxy-polyethyleneoxy-di-succinate

The silver iodobromide emulsions used in the emulsion layers other than the 10th layer were prepared in the same way so as to give different average grain sizes and silver iodide contents, by varying the average grain size of seed grains, temperature, pAg, pH, flow rate, addition time and halide composition.

Each of these emulsions, which were monodispersed emulsions comprised core/shell type grains having a distribution extent not more than 20%, was optimally chemically ripened in the presence of sodium thiosulfate, chloroauric acid and ammonium thiocyanate. Then, sensitizing dyes, 4-hydroxy-6-methyl-1,3,3a,7-tetrazaindene and 1-phenyl-5-mercaptotetrazole were added thereto.

In addition to the above components, photographic light-sensitive materials 1 to 5 contained compounds Su-1 and Su-2, thickener, hardeners H-1 and H-2, stabilizer ST-1, antifoggants AF-1 and AF-2 (weight average molecular weights were 10,000 and 1,100,000, respectively), dyes AI-1 and AI-2, and compound DI-1 (9.4 mg/m$^2$).

<Preparation of Samples 023 to 026>

Sample Nos. 023 to 026 were prepared using Support 1 in the same manner as in Samples Nos. 003 to 006 except that the below-mentioned <Coating solution for subbing B-7> was used in place of <Coating solution for subbing B-4> and <Coating solution for subbing B-6>.

<Coating solution for subbing B-7>

| | |
|---|---|
| Compound UL-7 | 0.5 g |
| Resorcinol | 4 g |

-continued
<Coating solution for subbing B-7>
| | |
|---|---|
| Metanol | 95 ml |
| Water | 5 ml |
UL-1
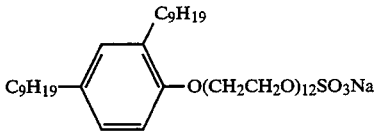
UL-2
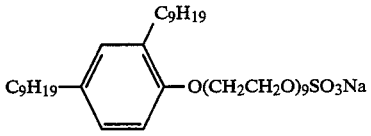
UL-4
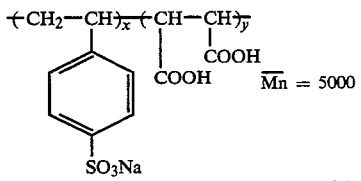
$\overline{Mn}$ = 5000
x:y = 75:25 (weight ratio)
UL-5
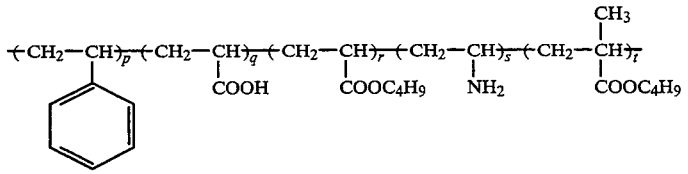
p:q:r:s:t = 40:5:10:5:40 (weight ratio)
UL-6
a mixture of
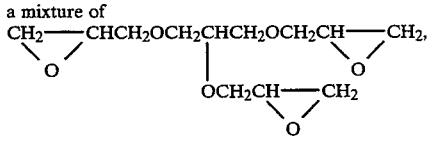
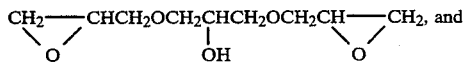
and
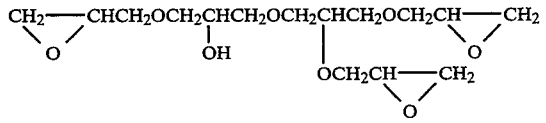
C-1
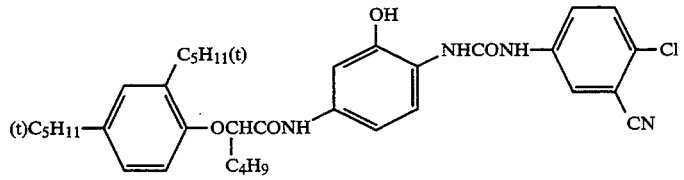
C-2
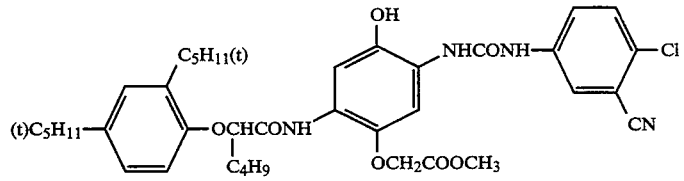

-continued
<Coating solution for subbing B-7>
M-1
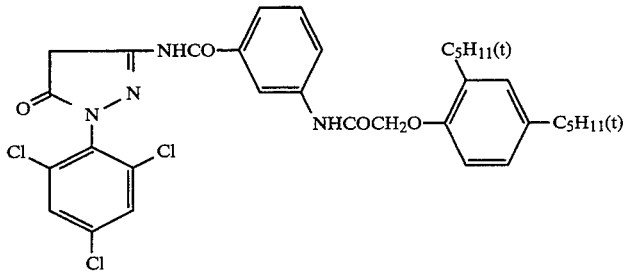
M-2
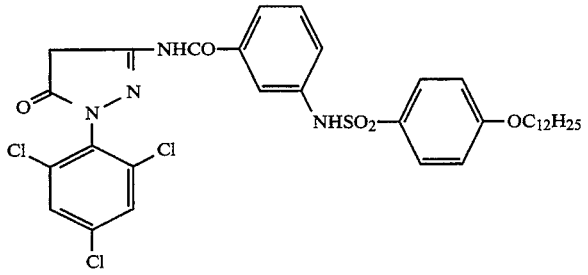
Y-1
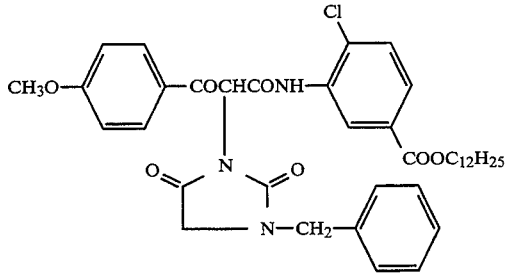
Y-2
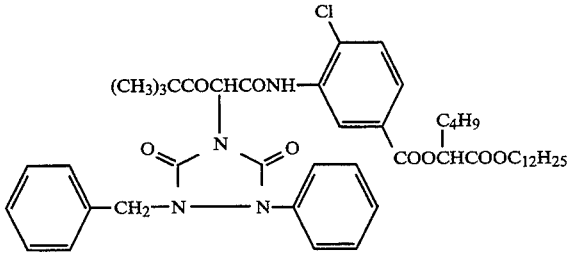
CC-1
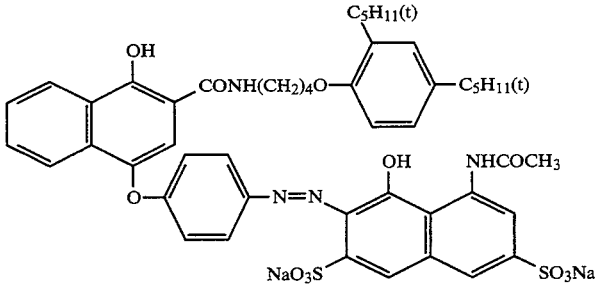

-continued
<Coating solution for subbing B-7>
CM-1
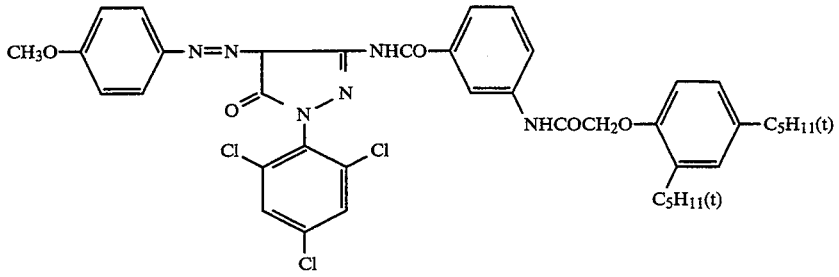
D-1
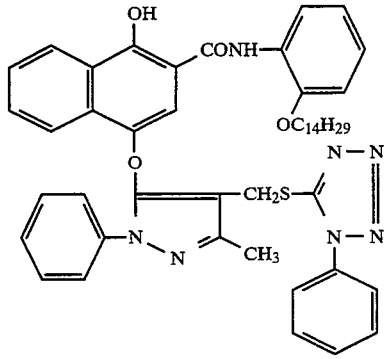
D-2
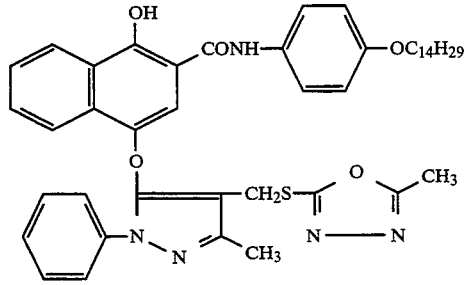
D-3
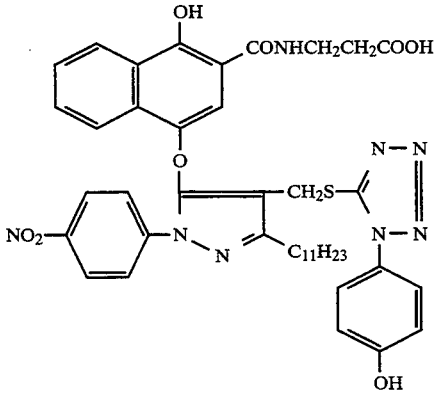
UV-1
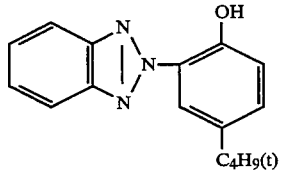

-continued
<Coating solution for subbing B-7>
UV-2
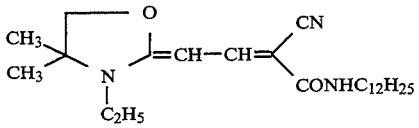
S-1
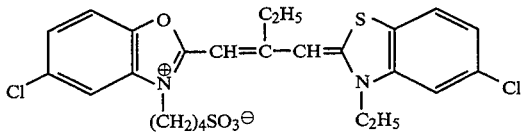
S-2
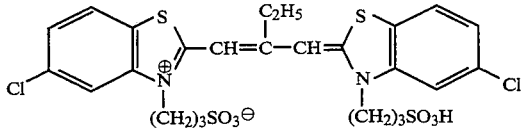
S-3
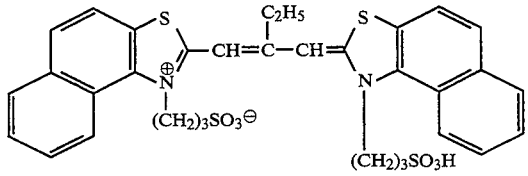
S-4
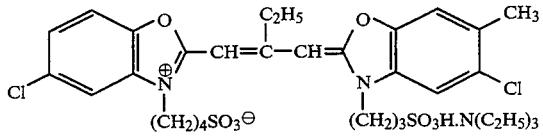
S-5
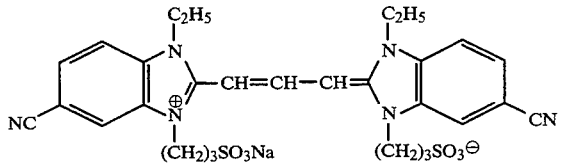
S-6
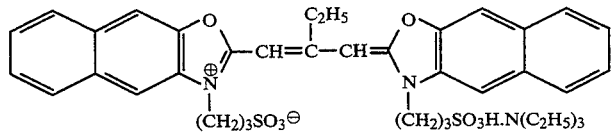
S-7
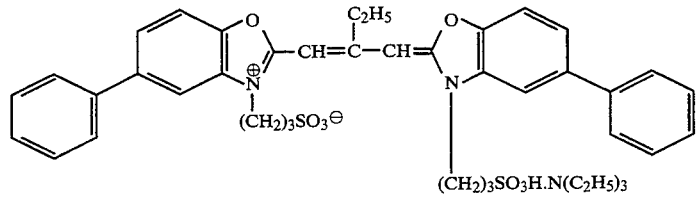
S-8
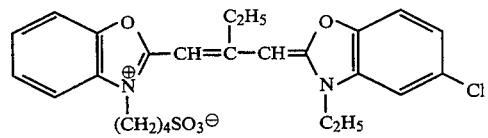

-continued
<Coating solution for subbing B-7>
S-9
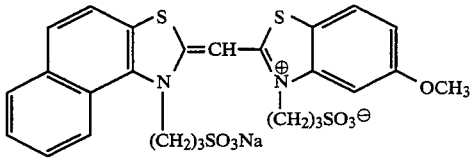
S-10
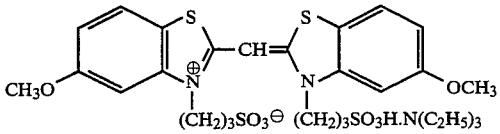
S-11
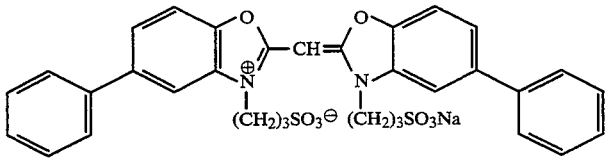
HS-1
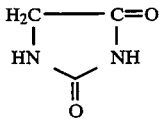
HS-2
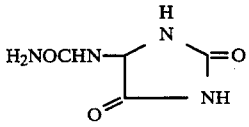
SC-1
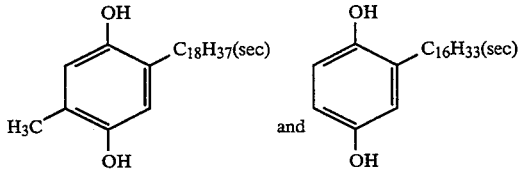
(mixture of 2:3)
Oil-1
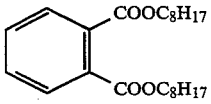
Oil-2
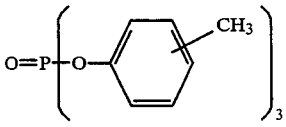
Oil-3
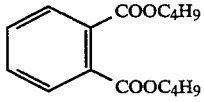
H-1
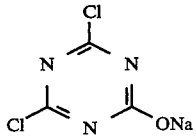
H-2
$(CH_2{=}CHSO_2CH_2)_2O$ -continued
<Coating solution for subbing B-7>
SU-1
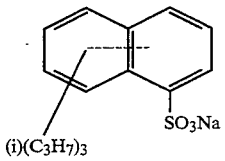
SU-2
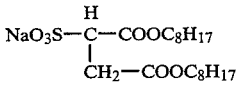
FK-1 $C_8F_{17}SO_2NH-(CH_2)_3-N^+(CH_3)_3$ $Br^-$
FA-1
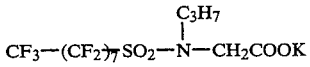
Compound A
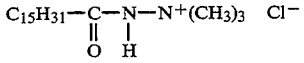
Compound B
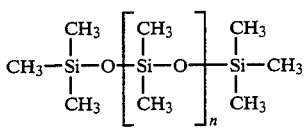
weight average molecular weight = 30,000
Compound C
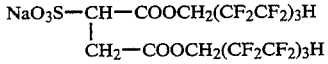
DI-1 (A mixture of the following three components)
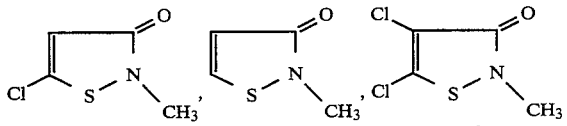
Component A Component B Component C
component A:component B:component C = 50:46:4 (mole ratio)
AI-1
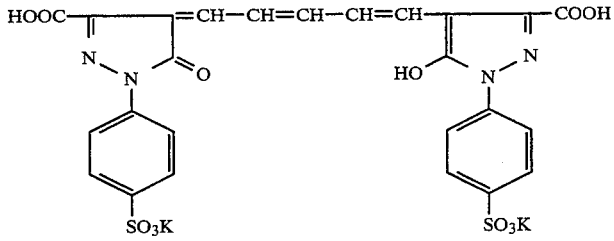
AI-2
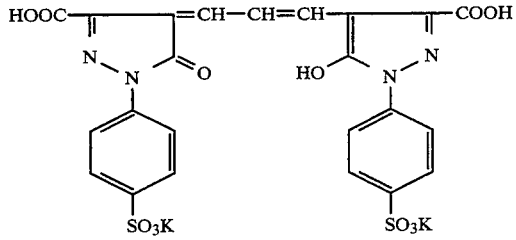
ST-1
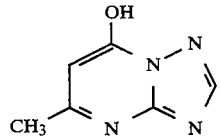

-continued

<Coating solution for subbing B-7>

AF-1

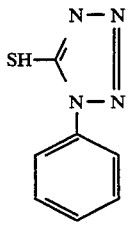

AF-2

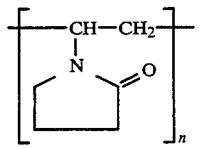

UL-3

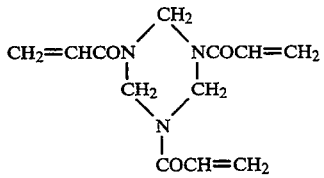

UL-7

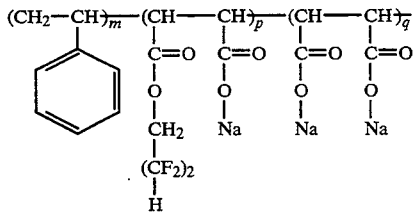

(m = 50, p = 20, q = 30)

(Method of Evaluation)

Photographic light-sensitive materials 001 to 026 were evaluated as described below. The results are shown in Table 1.

<Degree of curling>

After the emulsion layers and the backing layers of light-sensitive materials Nos. 001 to 026 were peeled off using pancreatine to obtain supports and the supports were cut by 35 mm in the lateral direction ×2–3 mm in the longitudinal direction. After the resulting supports stood at 23° C. and 20% RH for 24 hours, the curling degree was measured according to the international standard ISO 4330. It was defined to be the degree of curling thereof.

No difference of the degree of curling on each support between before and after the coating of emulsion layers and the backing layers was observed.

<Scratch>

Prints of light-sensitive materials Nos. 001 to 026 wherein a color negative film sample developed was printed using a printer under the circumstances of 23 ° C. and 20% RH in the manner that the magnification of the resolution chart is 0.061 were evaluated visually in terms of the degree of scratches on the backing surface occurred in the printer.

A: No scratches occurred.

B.: Few scratches occurred.

C: Scratches occurred in a considerable number.

The levels A or B cause no problem in practical use.

In addition, resolution of prints printed in the size of 82×117 mm (distinguishable number of lines 1 mm the spacial frequency in terms of special frequency) was observed visually.

<Stain>

Light-sensitive materials 001 to 026 were subjected to development using a cine automatic processor NCV-60 (produced by Noritsu Koki Co., Ctd.) so that the rate of stain of the backing layers on the length of film (117 cm) was evaluated under the following criteria:

A: Less than 1%

B: Not less than 1% and less than 10%

C: Not less than 10% and less than 50%

D: Not less than 50% and less than 100%

The rate of A and B caused no practical problems.

TABLE 1

| Sample No. | Inv./ Comp. | Support No. | Support Proportion of layers | Support | Degree of curling (l/m) | Added amount of gelatin in the backing layer (g/m$^2$) | Ratio of added amount between the backing layer and the emulsion layers | Inequality A* B** | Scratches on the backing layer after printing | Resolution on printed image (line/mm) | Stain due to a cine automatic processor |
|---|---|---|---|---|---|---|---|---|---|---|---|
| 001 | Comp. | 1 | Single | — | 0 | 6.0 | 0.44 | B | C | 2 | A |

TABLE 1-continued

| Sample No. | Inv./ Comp. | Support No. | Support Proportion of layers | Support Degree of curling (l/m) | Added amount of gelatin in the backing layer (g/m$^2$) | Ratio of added amount between the backing layer and the emulsion layers | Inequality A* B** | Scratches on the backing layer after printing | Resolution on printed image (line/mm) | Stain due to a cine automatic processor |
|---|---|---|---|---|---|---|---|---|---|---|
| | | | layer of PET | | | | | | | |
| 002 | Comp. | 1 | Single layer of PET | — | 0 | 12.0 | 0.89 | B | A | 9 | D |
| 003 | Comp. | 2 | Single layer of PET | — | −10 | 12.0 | 0.89 | B | A | 9 | D |
| 004 | Inv. | 2 | Single layer of PET | — | −10 | 9.0 | 0.67 | A | A | 10 | A |
| 005 | Inv. | 2 | Single layer of PET | — | −10 | 6.0 | 0.44 | A | A | 10 | A |
| 006 | Inv. | 2 | Single layer of PET | — | −10 | 3.0 | 0.22 | A | A | 10 | A |
| 007 | Comp. | 3 | Polyester laminated layer | 0.9:1:1.1 | −2 | 12.0 | 0.89 | B | A | 9 | D |
| 008 | Inv. | 3 | Polyester laminated layer | 0.9:1:1.1 | −2 | 9.0 | 0.67 | A | A | 9 | A |
| 009 | Inv. | 3 | Polyester laminated layer | 0.9:1:1.1 | −2 | 6.0 | 0.44 | A | A | 9 | A |
| 010 | Inv. | 3 | Polyester laminated layer | 0.9:1:1.1 | −2 | 2.0 | 0.15 | B | B | 5 | A |
| 011 | Comp. | 4 | Polyester laminated layer | 0.7:1:1.3 | −15 | 12.0 | 0.89 | B | A | 9 | D |
| 012 | Inv. | 4 | Polyester laminated layer | 0.7:1:1.3 | −15 | 9.0 | 0.67 | A | A | 10 | A |
| 013 | Inv. | 4 | Polyester laminated layer | 0.7:1:1.3 | −15 | 6.0 | 0.44 | A | A | 10 | A |
| 014 | Inv. | 4 | Polyester laminated layer | 0.7:1:1.3 | −15 | 3.0 | 0.22 | A | A | 10 | A |
| 015 | Comp. | 5 | Polyester laminated layer | 0.6:1:1.4 | −25 | 12.0 | 0.89 | B | A | 9 | D |
| 016 | Inv. | 5 | Polyester laminated layer | 0.6:1:1.4 | −25 | 9.0 | 0.67 | B | A | 10 | B |
| 017 | Inv. | 5 | Polyester laminated layer | 0.6:1:1.4 | −25 | 6.0 | 0.44 | A | A | 10 | A |
| 018 | Inv. | 5 | Polyester laminated layer | 0.6:1:1.4 | −25 | 3.0 | 0.22 | A | A | 10 | A |
| 019 | Comp. | 6 | Polyester laminated layer | 0.4:1:1.6 | −40 | 12.0 | 0.89 | B | A | 9 | D |
| 020 | Inv. | 6 | Polyester laminated layer | 0.4:1:1.6 | −40 | 9.0 | 0.67 | B | A | 9 | B |
| 021 | Inv. | 6 | Polyester laminated layer | 0.4:1:1.6 | −40 | 6.0 | 0.44 | B | A | 9 | B |
| 022 | Inv. | 6 | Polyester laminated layer | 0.4:1:1.6 | −40 | 3.0 | 0.22 | A | A | 10 | A |
| 023 | Comp. | 1 | Single layer of PET | — | −5 | 12.0 | 0.89 | B | A | 9 | D |
| 024 | Inv. | 1 | Single layer of PET | — | −5 | 9.0 | 0.67 | A | A | 10 | A |
| 025 | Inv. | 1 | Single layer of PET | — | −5 | 6.0 | 0.44 | A | A | 10 | A |
| 026 | Inv. | 1 | Single layer of | — | −5 | 2.0 | 0.15 | B | B | 5 | A |

TABLE 1-continued

| Sample No. | Inv./ Comp. | Support No. | Support Proportion of layers | Support Degree of curling (l/m) | Added amount of gelatin in the backing layer (g/m²) | Ratio of added amount between the backing layer and the emulsion layers | Inequality A* B** | Scratches on the backing layer after printing | Resolution on printed image (line/mm) | Stain due to a cine automatic processor |
|---|---|---|---|---|---|---|---|---|---|---|
| | | | PET | | | | | | | |

Inv.: Invention
Comp.: Comparative
*A satisfies the Inequality.
**B does not satisfy the Inequality.

As is apparent from Table 1, when the ratio of the gelatin content of the backing layer to that of the emulsion layer of a light-sensitive material which is curled to the backing layer side is in the range of from 0.05 to 0.7, the degrees of scratches and resolution are also excellent. In addition, the degree of stain caused by a cine automatic processor is also excellent. When the ratio is out of the above-mentioned range, the scratches, the resolution or the stain caused by a cine automatic processor is deteriorated. We also prepared supports having the degree of curling of −45, we could not adjust the curl balance appropriately.

What is claimed is:

1. A silver halide photographic light-sensitive material comprising a curled polyester film support having a first side and an opposite second side, wherein said first side of said support has a concave curl, a silver halide emulsion layer provided on said second side of said support, and a backing layer provided on said first side of said support, a ratio of the total gelatin content per unit area of said backing layer to the gelatin content of said emulsion layer being 0.05 to 0.7:1.

2. The material of claim 1, wherein the polyester film support is comprised of not less than two polyester films.

3. The material of claim 1 wherein the degree of curling of said support represented by a 1/R value at 23° C. and 20% RH, in accordance with ISO (International Standard Organization) 4330 is −1 to −40 l/m, R being defined as radius of curvature.

4. The material of claim 3, wherein the polyester film support is comprised of not less than two polyester films.

5. The material of claim 3, wherein the relation between the degree of curling of the support and the ratio of the total gelatin content per unit area of the backing layer to that of the silver halide emulsion layer satisfies the following inequality:

$$(K+15)/50 \leqq X \leqq (K+55)/50$$

wherein K represents a 1/R value (unit: l/m) at 23° C. and 20% RH according to ISO 4330, and X represents the ratio of the total gelatin content per unit area of the backing layer to that of the silver halide emulsion layer.

6. The material of claim 1, wherein the thickness of the support is not more than 125 μm.

7. The material of claim 1, wherein the thickness of the support is 50 to 115 μm.

8. The material of claim 1, wherein the support includes a copolyester comprising in an amount of 2 to 7 mol % a unit derived from an aromatic dicarboxylic acid having a metal sulfonate group.

9. The material of claim 8, wherein the copolyester further comprises a unit derived from a polyalkylene glycol and/or a saturated aliphatic dicarboxylic acid in an amount of 3 to 10 weight %.

10. The material of claim 1, wherein the gelatin content of the silver halide emulsion layer is 0.5 to 30 g/m² and the gelatin content of the backing layer is 0.1 to 15 g/m² a

11. The material of claim 1 wherein the polyester from which said polyester film support is formed has an intrinsic viscosity of 0.4 to 1.0 when measured at 20° C., using a mixed solvent of 60 wt % phenol and 40 wt % 1,1,2,2,-tetrachloroethane.

12. The material of claim 1 wherein the thickness of said backing layer is 0.5 to 15 μm.

13. The material of claim 2 wherein the support comprises three polyester film layers, and the thickness of the outer layers of the polyester film are different from each other.

14. The material of claim 1 wherein said material is in roll form.

15. The material of claim 2 wherein said material is a color silver halide photographic light-sensitive material.

16. The material of claim 1 wherein said material has a longitudinal side and a lateral side, and said material curls in the lateral direction.

17. The material of claim 16 wherein a length of said lateral side of said material is 35 mm.

* * * * *